US009778603B2

(12) United States Patent
Kato et al.

(10) Patent No.: US 9,778,603 B2
(45) Date of Patent: Oct. 3, 2017

(54) TRANSFER DEVICE AND IMAGE FORMING APPARATUS INCORPORATING SAME

(71) Applicants: Tsutomu Kato, Kanagawa (JP); Masakazu Imai, Kanagawa (JP); Osamu Ichihashi, Kanagawa (JP); Katsuhito Haruno, Kanagawa (JP); Takahiro Konishi, Kanagawa (JP)

(72) Inventors: Tsutomu Kato, Kanagawa (JP); Masakazu Imai, Kanagawa (JP); Osamu Ichihashi, Kanagawa (JP); Katsuhito Haruno, Kanagawa (JP); Takahiro Konishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/191,463

(22) Filed: Jun. 23, 2016

(65) Prior Publication Data

US 2017/0010566 A1 Jan. 12, 2017

(30) Foreign Application Priority Data

Jul. 7, 2015 (JP) ..... 2015-135913

(51) Int. Cl.
*G03G 15/16* (2006.01)

(52) U.S. Cl.
CPC ..... *G03G 15/1665* (2013.01); *G03G 15/1605* (2013.01); *G03G 2215/00447* (2013.01); *G03G 2215/00738* (2013.01); *G03G 2215/00751* (2013.01); *G03G 2215/0129* (2013.01)

(58) Field of Classification Search
USPC ..... 399/38, 45, 66, 107, 110, 121
See application file for complete search history.

(56) References Cited

U.S. PATENT DOCUMENTS

| | | | | |
|---|---|---|---|---|
| 8,682,189 | B2 * | 3/2014 | Shimizu | G03G 15/1675 399/66 |
| 2009/0279906 | A1 | 11/2009 | Kuma et al. | |
| 2010/0003051 | A1 | 1/2010 | Sekina et al. | |
| 2010/0142985 | A1 | 6/2010 | Minbe et al. | |
| 2010/0221029 | A1 | 9/2010 | Minbu et al. | |
| 2011/0158690 | A1 | 6/2011 | Mimbu et al. | |
| 2012/0121293 | A1 | 5/2012 | Mimbu et al. | |
| 2013/0223901 | A1 | 8/2013 | Minbe et al. | |

(Continued)

FOREIGN PATENT DOCUMENTS

| | | |
|---|---|---|
| JP | 2010-204259 | 9/2010 |
| JP | 2014-224941 | 12/2014 |

*Primary Examiner* — Hoan Tran
(74) *Attorney, Agent, or Firm* — Duft Bornsen & Fettig LLP

(57) ABSTRACT

A transfer device includes an image bearer and a transfer rotator. The transfer device further includes an adjuster including a rotatable cam and an opposed member opposed to the cam. The cam alternately contacts and separates the transfer rotator against and from the image bearer, having a continuous sloped surface with a plurality of positions, each position to contact the opposed member to obtain a different amount of separation between the image bearer and the transfer rotator. The transfer device further includes a controller to control the adjuster to adjust the amount of separation between the transfer rotator and the image bearer according to thickness or type of the recording medium when the recording medium starts to enter the transfer nip.

19 Claims, 7 Drawing Sheets

(56) References Cited

U.S. PATENT DOCUMENTS

| | | | |
|---|---|---|---|
| 2013/0243482 | A1 | 9/2013 | Kato et al. |
| 2014/0072340 | A1 | 3/2014 | Kato et al. |
| 2014/0314435 | A1 | 10/2014 | Kato et al. |
| 2014/0328604 | A1 | 11/2014 | Tanaka et al. |
| 2014/0334847 | A1 | 11/2014 | Takahashi et al. |
| 2015/0346651 | A1 | 12/2015 | Nagata et al. |
| 2016/0139543 | A1 | 5/2016 | Imai et al. |

* cited by examiner

TRANSFER DEVICE AND IMAGE FORMING APPARATUS INCORPORATING SAME

CROSS-REFERENCE TO RELATED APPLICATION

This patent application is based on and claims priority pursuant to 35 U.S.C. §119(a) to Japanese Patent Application No. 2015-135913, filed on Jul. 7, 2015, in the Japan Patent Office, the entire disclosure of which is hereby incorporated by reference herein.

BACKGROUND

Technical Field

Exemplary aspects of the present disclosure generally relate to an image forming apparatus, such as a copier, a facsimile machine, a printer, or a multi-functional system including a combination thereof, and more particularly to a transfer device employed in the image forming apparatus.

Related Art

There is known a transfer device for use in an image forming apparatus that transfers a toner image from an image bearer onto a recording medium in a transfer nip formed by a nip forming device contacting the image bearer.

SUMMARY

In an aspect of this disclosure, there is provided an improved transfer device including an image bearer to bear a toner image and a transfer rotator to contact the image bearer to form a transfer nip to transfer the toner image from the image bearer onto a recording medium interposed between the image bearer and the transfer rotator. The transfer device further includes an adjuster including a rotatable cam and an opposed member opposed to the cam. The cam alternately contacts and separates the transfer rotator against and from the image bearer. The cam has a continuous sloped surface with a plurality of positions, each position to contact the opposed member to obtain a different amount of separation between the image bearer and the transfer rotator. The transfer device further includes a controller operatively connected to the adjuster to control the adjuster to adjust the amount of separation between the transfer rotator and the image bearer according to type or thickness of the recording medium when the recording medium starts to enter the transfer nip.

In another aspect of this disclosure, there is provided an improved transfer device including an image bearer to bear a toner image and a transfer rotator to contact a surface of the image bearer to form a transfer nip to transfer the toner image from the image bearer onto a recording medium interposed between the image bearer and the transfer rotator. The transfer device further includes an adjuster including a rotatable cam and an opposed member opposed to the cam. The cam alternately contacts and separates the transfer rotator against and from the image bearer. The cam has a first circumferential portion to contact the opposed member to obtain a greatest amount of separation between the image bearer and the transfer rotator and a second circumferential portion to separate from the opposed member to contact the transfer rotator with the image bearer. The cam has a plurality of positions in a circumferential surface ranging from the first circumferential portion to the second circumferential portion on one side of a direction of rotation of the cam, each position to obtain a different amount of separation between the image bearer and the transfer rotator, smaller than the greatest amount of separation at the first circumferential portion. The transfer device further includes a controller to control the adjuster to adjust the amount of separation between the transfer rotator and the image bearer at each of the plurality of positions according to type or thickness of the recording medium when the recording medium starts to enter the transfer nip.

Further described are improved imaging forming apparatuses incorporating the transfer devices described above.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1A:
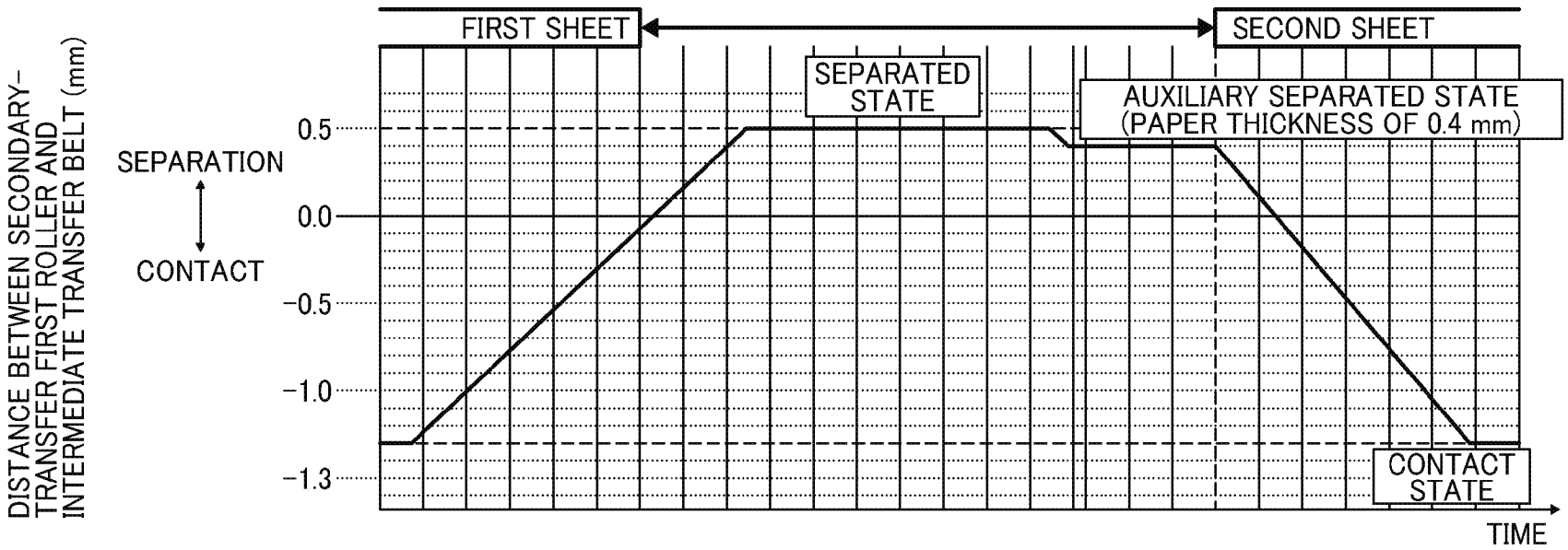
FIG. 1A is a diagram of a sequence of a contact-and-separation operation for secondary transfer during printing on thick paper.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

In the drawings for describing the following embodiments, the same reference codes are allocated to elements (members or components) having the same function or shape and redundant descriptions thereof are omitted below.

Commercially available recording sheets typically have a thickness of from 0.05 mm through 0.44 mm. To address such thickness, an appropriate amount of separation when a recording sheet enters a secondary transfer nip approximately ranges from a thickness obtained by subtracting "−0.1" mm from the thickness of the recording sheet to a thickness obtained by adding "+0.05" mm to the thickness of the recording sheet. With a configuration in which the amount of separation is changed by different heights of two convex portions of a cam, an appropriate amount of separation is not set according to the thickness of the recording sheet, which may fail to effectively reduce shock jitter. With too small a separation for the thickness of the recording sheet, the impact is produced when the recording sheet enters the secondary transfer nip, thereby failing to effectively reduce shock jitter. In contrast, with too great a separation for the thickness of the recording sheet, the impact produced by the recording sheet coming into contact with the intermediate transfer belt increases, which leads to an unexpected change in the speed of travel of the intermediate transfer belt, thus producing a shock jitter.

A description is provided of a transfer device applied to a tandem multicolor copier as an example of an electrophotographic image forming apparatus (hereinafter, referred to simply as an image forming apparatus) 1 according to an embodiment of the present disclosure. FIG. 1 is a schematic view of the image forming apparatus according to an embodiment of the present disclosure. The image forming apparatus includes a printer unit 100, a paper feed unit 200, and a scanner 300. The printer unit 100 includes an intermediate transfer belt 10 formed into an endless loop. The intermediate transfer belt 10 is entrained about and stretched taut between a drive roller 14, a driven roller 15, and a secondary-transfer second roller 16 in such a manner that the loop of the intermediate transfer belt 10 looks like an inverted triangle shape as viewed from the side. The rotation of the drive roller 14 endlessly moves the intermediate transfer belt 10 in a clockwise direction indicated by an arrow.

The printer unit 100 includes image forming stations 18Y, 18M, 18C, and 18K for the colors yellow, magenta, cyan, and black, in respective above the looped intermediate transfer belt 10 along the direction of rotation of the intermediate transfer belt 10. It is to be noted that the suffixes Y, M, C, and K denote colors yellow, magenta, cyan, and black, respectively. To simplify the description, the reference characters Y, M, C, and K indicating colors are omitted herein unless otherwise specified. As illustrated in FIG. 1, the image forming stations 18Y, 18M, 18C, and 18K include photoconductors 20Y, 20M, 20C, and 20K, developing devices 61Y, 61M, 61C, and 61K, photoconductor cleaners 63Y, 63M, 63C, and 63K, respectively. The photoconductors 20Y, 20M, 20C, and 20K contact the intermediate transfer belt 10 to form primary transfer nips between the respective photoconductors 20Y, 20M, 20C, and 20K and the intermediate transfer belt 10. The photoconductors 20Y, 20M, 20C, and 20K are driven to rotate in a counterclockwise direction indicated by an arrow by a drive device while contacting the intermediate transfer belt 10. Each of the developing devices 61Y, 61M, 61C, and 61K develops an electrostatic latent image formed on the photoconductors 20Y, 20M, 20C, and 20K, respectively, by supplying toners of respective colors yellow, magenta, cyan, and black. The photoconductor cleaners 63Y, 63M, 63C, and 63K remove residual toner remaining on the photoconductors 20Y, 20M, 20C, and 20K after a primary transfer process, that is, after the photoconductors 20Y, 20M, 20C, and 20K pass through the primary transfer nips.

In the image forming apparatus 1 according to the present embodiment, the four image forming stations 18Y, 18M, 18C, and 18K arranged in tandem in the direction of rotation of the intermediate transfer belt 10 constitute a tandem image forming unit. The printer unit 100 includes an optical writing unit 21 substantially above the tandem image forming unit. The optical writing unit 21 optically scans the surface of the photoconductors 20Y, 20M, 20C, and 20K rotating in the counterclockwise direction to form electrostatic latent images on the surfaces of the photoconductors 20Y, 20M, 20C, and 20K in optical writing process. Prior to the optical writing process, the surfaces of the photoconductors 20Y, 20M, 20C, and 20K are uniformly charged by charging devices of the image forming stations 18Y, 18M, 18C, and 18K.

A transfer unit 60 includes the intermediate transfer belt 10 and primary transfer rollers 62Y, 62M, 62C, and 62K disposed inside the loop of the intermediate transfer belt 10. The intermediate transfer belt 10 is interposed between the primary transfer rollers 62Y, 62M, 62C, and 62K, and the photoconductors 20Y, 20M, 20C, and 20K. The primary transfer rollers 62Y, 62M, 62C, and 62K pressingly contact the back of the intermediate transfer belt 10 against the photoconductors 20Y, 20M, 20C, and 20K contacting the intermediate transfer belt 10 to form the primary transfer nips, respectively. A secondary-transfer first roller 24 is disposed below the intermediate transfer belt 10 or outside the loop of the intermediate transfer belt 10. The secondary-transfer first roller 24 contacts a portion of the front surface or the image bearing surface of the intermediate transfer belt 10 wound around the secondary-transfer second roller 16, thereby forming a secondary transfer nip between the secondary-transfer first roller 24 and the intermediate transfer belt 10. A sheet of recording medium (hereinafter referred to as a recording sheet) is timed to arrive at the secondary transfer nip at a predetermined time. In the secondary-transfer nip, the four-color composite toner image is secondarily transferred from the intermediate transfer belt 10 onto the recording sheet P.

The scanner 300 includes a reading device 336, i.e., a reading sensor that reads image information of a document placed on an exposure glass 332. The obtained image information is sent to a controller 70 of the printer unit 100. Based on the image information provided by the scanner 300, the controller 70 controls a light source, such as a laser diode, or a light emitting diode (LED), in the optical writing unit 21 to optically scan the photoconductors 20Y, 20M, 20C, and 20K with light for each color. Accordingly, an electrostatic latent image is formed on the surface of each of the photoconductors 20Y, 20M, 20C, and 20K. Subsequently, the electrostatic latent image is developed with toner of each color through developing process into toner images, one for each of the colors yellow (Y), magenta (M), cyan (C), and black (K).

The paper feed unit 200 includes a paper bank 43, multiple paper cassettes 44, feed rollers 42, separation rollers 45, a sheet passage 46, and conveyor rollers 47. One of the feed rollers 42 is selectively rotated so as to feed a recording sheet P from one of the paper cassettes 44 disposed in the paper bank 43. Each of the separation rollers 45 separates a sheet from the stack of recording sheets P and feeds it to the sheet passage 46. Each of the conveyor rollers 47 delivers the recording sheet P to a sheet passage 48 of the printer unit 100. In addition to the paper feed unit 200, the recording sheet P can be manually supplied using a bypass tray 51 and a separation roller 52. The separation roller 52 picks up and feeds a sheet of recording sheets P loaded on the bypass tray 51 to a sheet passage 53 one sheet at a time. The sheet passage 53 meets the sheet passage 48 in the printer unit 100. Substantially at the end of the sheet passage 48, a registration roller pair 49 is disposed. After the recording sheet P delivered along the sheet passage 48 is interposed between the registration roller pair 49, the registration roller pair 49 feeds the recording sheet P to the secondary transfer nip in the predetermined timing such that the recording sheet P is aligned with the composite toner image formed on the intermediate transfer belt 10 in the secondary transfer nip.

Still referring to FIG. 1, a description is provided of image forming operation for a color image. First, a document is placed on a document table 330 of an auto document feeder (hereinafter simply referred to as ADF) 400 or is placed on an exposure glass 332 of the scanner 300 by opening the ADF 400. When the document is placed on the exposure glass 332, the ADF 400 is closed to hold the document. Then, a start button is pressed by users. With a document placed on the ADF 400, the document is sent onto the exposure glass 332. Subsequently, the scanner 300 is activated, thereby moving a first carriage 333 and a second carriage 334 along the document surface. A light source of the first carriage 333 emits light against the document, which is then reflected on the document. The reflected light is reflected towards the second carriage 334. Mirrors of the second carriage 334 reflect the light toward an imaging lens 335 which directs the light to the reading device 336. The reading device 336 reads the document. This configuration allows the document, an image of which has been scanned, to be discharged.

As the printer unit 100 receives the image information from the scanner 300, a recording sheet P having an appropriate size corresponding to the image information is supplied to the sheet passage 48. The intermediate transfer belt 10 is endlessly rotated in the clockwise direction by the drive roller 14 which is rotated by a drive motor. In the meantime, the photoconductors 20Y, 20M, 20C, and 20K of the image forming stations 18Y, 18M, 18C, and 18K are rotated, and the photoconductors 20Y, 20M, 20C, and 20K are subjected to various imaging processes, such as charging, optical writing, and development. Through these processes, toner images of yellow, cyan, magenta, and black formed on the surface of photoconductors 20Y, 20M, 20C, and 20K are primarily transferred onto the surface of the intermediate transfer belt 10 in the respective primary transfer nips such that the toner images for the colors are superimposed one atop the other, thereby forming a four-color composite toner image on the intermediate transfer belt 10.

In the paper feed unit 200, one of the feed rollers 42 is selectively rotated in accordance with the size of a recording sheet P so as to feed the recording sheet from one of the paper cassettes 44 disposed in the paper bank 43. The recording sheet P picked up by the feed roller 42 is fed to the sheet passage 46 one by one by the separation roller 45. Subsequently, the recording sheet P is delivered to the sheet passage 48 in the printer unit 100 by the conveyor rollers 47. When using the bypass tray 51, a feed roller 50 of the bypass tray 51 is driven to rotate to pick up the recording sheet P loaded on the bypass tray 51. Then, the separation roller 52 separates and feeds the recording sheet to the sheet passage 53. The recording sheet is delivered to the sheet passage 48. Near the sheet passage 48, the leading end of the recording sheet P comes into contact with the registration roller pair 49, and delivery of the recording sheet P stops temporarily. Subsequently, the registration roller pair 49 starts to rotate again to feed the recording sheet P to the secondary transfer nip in appropriate timing such that the recording sheet P is aligned with the four-color composite toner image formed on the intermediate transfer belt 10 in the secondary transfer nip. In the secondary transfer nip, due to the nip pressure and electric field, the composite toner image is secondarily transferred onto the recording sheet at one time.

The recording sheet P, onto which the composite toner image is transferred at the secondary transfer nip, is conveyed on a conveyor belt 22 and delivered to a fixing device 25. The fixing device 25 includes a pressing roller 27 and a fixing belt 26 contacting the pressing roller 27 to form a fixing nip between the pressing roller 27 and the fixing belt 26. In the fixing device 25, the composite toner image is fixed on the recording sheet P as the recording sheet P passes through the fixing nip between the fixing belt 26 and the pressing roller 27 where heat and pressure are applied. After the color toner image is formed on the recording sheet P, the recording sheet P is output by an output roller pair 56 onto an output tray 57 disposed at the exterior wall of the printer unit 100.

In the case of duplex printing, after the recording sheet P is discharged from the fixing device 25, a switching claw 55 changes the delivery path of the recording sheet to send it to a reversing unit 28. In the reversing unit 28, the recording sheet P is turned upside down and returned to the registration roller pair 49 to pass through the secondary transfer nip and the fixing device 25 again. A belt cleaner 17 is disposed outside the loop of the intermediate transfer belt 10 and contacts the intermediate transfer belt 10 upstream from the primary transfer nip for yellow, which is at the extreme upstream end in the primary transfer process among the four colors.

Figure 3:
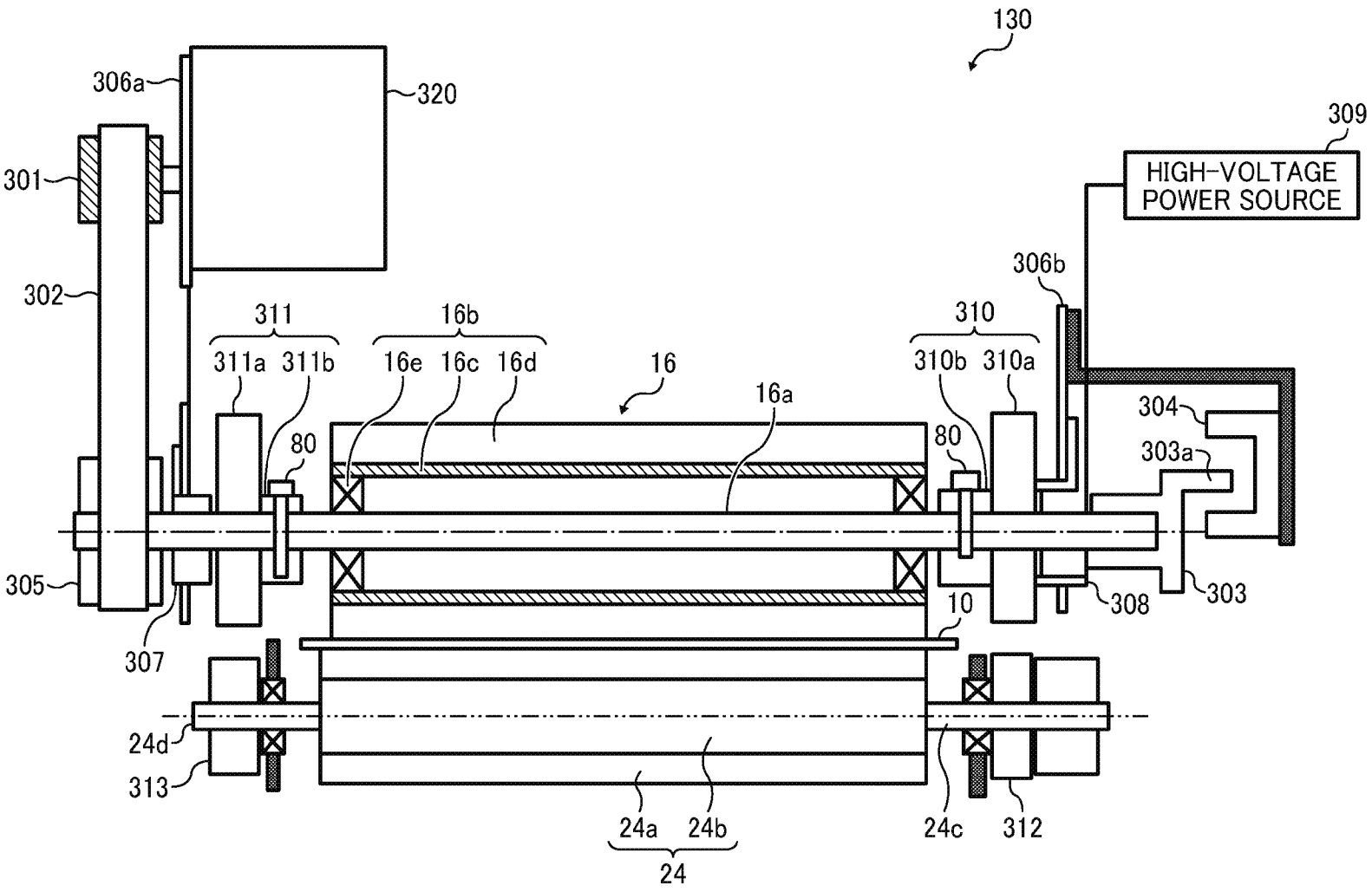
FIG. 3 is a schematic view of a contact-separation mechanism as an adjuster to alternately contact and separate a secondary-transfer first roller against and from the intermediate transfer belt.

Referring now to FIG. 3, there is provided a schematic view of a contact-separation mechanism 130 as an adjuster that alternately contacts and separates the intermediate transfer belt 10 and the secondary-transfer first roller 24 against and from each other. The secondary-transfer first roller 24 includes a hollow cored bar 24*b*, an elastic layer 24*a* fixed to the circumferential surface of the cored bar 24*b*, a first shaft 24*c*, a second shaft 24*d*, a first idler roller 312, and a second idler roller 313. The first shaft 24*c* and the second shaft 24*d* project from the respective end faces of the secondary-transfer first roller 24 in the axial direction, extending toward the respective rotational axis directions. The elastic layer 24*a* is formed of elastic material. The material constituting the cored bar 24*b* includes, but is not limited to, stainless steel and aluminum. The elastic layer 24*a* has a hardness of 70° or less on Japanese Industrial Standards (JIS)-A hardness scale, for example. In a configuration in which a cleaning device, such as a cleaning blade, contacts the secondary-transfer first roller 24 to clean the surface of the secondary-transfer first roller 24, the elastic layer 24*a*, which is too soft, may cause various problems such as damage. Therefore, it is desirable that the elastic layer 24*a* have a hardness of 40° or more on JIS-A hardness scale, for example.

However, without such cleaning device in the secondary-transfer first roller 24, a soft elastic layer 24*a* may be used, thereby preventing imaging failure caused by impact applied to the secondary transfer nip when the recording sheet P enters and exits the secondary transfer nip. Therefore, it is desirable that the elastic layer 24*a* have a hardness ranging from 30° through 50° on Asker C hardness scale. The conductive rubber material for the elastic layer 24*a* of the secondary-transfer first roller 24 includes, but is not limited to, conductive epichlorohydrin rubber, Ethylene Propylene Diene Monomer (EPDM) and Si rubber in which carbon is dispersed, nitrile butadiene rubber (NBR) having ionic conductive properties, and urethane rubber.

The elastic layer 24*a* fixed on the circumferential surface of the cored bar 24*b* is made of conductive rubber with an electrical resistance adjusted to 7.5 LogΩ. The electrical resistance of the elastic layer 24*a* is adjusted to a predetermined range to prevent concentration of transfer electric current at a particular place at which the intermediate transfer belt 10 and the secondary-transfer first roller 24 come into direct contact with each other without the recording sheet P in the secondary transfer nip when a relatively small recording sheet in the axial direction of the roller, such as A5-size, is used. With the elastic layer 24*a* having an electrical resistance greater than the electrical resistance of the recording sheet P, such concentration of the transfer electrical current is prevented. The conductive rubber material for the elastic layer 24*a* includes foam rubber having a hardness ranging from 30° to 50° on Asker C hardness scale. With this configuration, the elastic layer 24*a* flexibly deforms in a thickness direction in the secondary transfer nip, thereby making the secondary transfer nip relatively wide in a conveyance direction of the recording sheet P. The elastic layer 24*a* has a barrel shape with a center having a larger outer diameter than the diameter of the end portions. With this configuration, the pressure at the center portion of the secondary-transfer first roller 24 is prevented from decreasing when the secondary-transfer first roller 24 is pressed against the intermediate transfer belt 10 by a coil spring 351 (shown in FIG. 4) to form the secondary transfer nip and hence the secondary-transfer first roller 24 is bent. In such configuration, the secondary-transfer first roller 24 is pressed against the intermediate transfer belt 10 stretched taut and wound around the secondary-transfer second roller 16.

The secondary-transfer second roller 16 stretching the intermediate transfer belt 10 includes a cylindrical roller portion 16*b* as a main body and a shaft 16*a*. The shaft 16*a* penetrates through the center of rotation of the roller portion 16*b* in the axial direction while allowing the roller portion 16*b* to rotate idly freely on the shaft 16*a*. The shaft 16*a* is made of metal and allows the roller portion 16*b* to rotate idly on the circumferential surface of the shaft 16*a*. The roller portion 16*b* as a main body includes a drum-shaped cored bar 16*c*, an elastic layer 16*d*, and a ball bearing 16*e*. The elastic layer 16*d* is fixed on the circumferential surface of the cored bar 16*c* and made of elastic material. The ball bearing 16*e* is press fit to both ends of the cored bar 16*c* in the axial direction of the cored bar 16*c*. While supporting the cored bar 16*c*, the ball bearings 16*e* rotate on the shaft 16*a* together with the cored bar 16*c*. The elastic layer 16*d* is formed on the outer circumferential surface of the cored bar 16*c*.

More specifically, the shaft 16*a* is rotatably supported by a first shaft bearing 308 and a second ball bearing 307. The first shaft bearing 308 is fixed to a first lateral plate 306*b* of the transfer unit 60 that supports the intermediate transfer belt 10 in a stretched manner. The second ball bearing 307 is fixed to a second lateral plate 306*a*. However, it is to be noted that the shaft 16*a* does not rotate most of the time during a print job. The shaft 16*a* allows the roller portion 16*b*, which tries to rotate together with the intermediate transfer belt 10 traveling endlessly, to rotate idly on the shaft 16*a*. The elastic layer 16*d* is formed on the outer circumferential surface of the cored bar 16*c* and is made of ethylene propylene (EP) rubber that makes the resistance of 6.0 or less LogΩ. The rubber material for the elastic layer 16*d* includes EP rubber and nitrile butadiene rubber (NBR) so that the elastic layer 16*d* has a hardness of approximately 70° on JIS-A hardness scale.

A first cam 310 and a second cam 311 are respectively fixed to both ends of the shaft 16*a* of the secondary-transfer second roller 16, outboard of the roller portion 16*b* in the longitudinal direction. Each of the first cam 310 and the second cam 311 serves as a contact part that comes into contact with the secondary-transfer first roller 24. In this disclosure, the first cam 310 and the second cam 311 are sometimes collectively referred to as cams 310 and 311. The cams 310 and 311 are fixed onto the shaft 16*a* to rotate together with the shaft 16*a*. More specifically, the first cam 310 is fixed to one end of the shaft 16*a* of the secondary-transfer second roller 16 in the longitudinal direction of the shaft 16*a*. The first cam 310 includes a cam portion 310*a* and a true-circular roller portion 310*b*. The cam portion 310*a* and the roller portion 310*b* are arranged in the axial direction and constitute a single integrated unit. The roller portion 310*b* includes a pin 80 that penetrates through the shaft 16*a*, thereby fixing the first cam 310 to the shaft 16*a*. The second cam 311 has the same configurations as the first cam 310 does, and is fixed to the other end of the shaft 16*a* in the longitudinal direction of the shaft 16*a*.

Furthermore, a power receiving pulley 305 is fixed outboard of the second cam 311 in the axial direction of the shaft 16*a*. A detection target disk 303 is fixed to the shaft 16*a* outboard of the first cam 310 in the axial direction of the shaft 16*a*. A cam drive motor 320 is fixed to the second lateral plate 306*a* of the transfer unit 60. A motor pulley 301 disposed on the shaft of the cam drive motor 320 is rotated so as to transmit, via a timing belt 302, a drive force to the power receiving pulley 305 fixed onto the shaft 16*a*. With this configuration, driving the cam drive motor 320 rotates the shaft 16*a*. Even when the shaft 16*a* rotates, the roller portion 16*b* rotates idly freely on the shaft 16*a* so that the roller portion 16*b* rotates together with the intermediate transfer belt 10.

In the present embodiment, a stepping motor is employed as the cam drive motor 320, thereby providing a greater freedom in setting the angle of rotation of the motor without a rotation angle detector, such as an encoder. When the shaft 16*a* stops rotating at a predetermined angle, the convex portion of the cam portion 310*a* of the first cam 310 comes into contact with a first idler roller 312, and the convex portion of the cam portion 311*a* of the second cam 311 comes into contact with a second idler roller 313. The first idler roller 312 and the second idler roller 313 are disposed on the shaft of the secondary-transfer first roller 24. Accordingly, the secondary-transfer first roller 24 is pushed against the pressure of the coil spring 351 of a swing device 350. With this configuration, moving the secondary-transfer first roller 24 away from the secondary-transfer second roller 16 (and thus the intermediate transfer belt 10) adjusts the distance between the shaft 16*a* of the secondary-transfer second roller 16 and the shaft 24*d* and 24*c* of the secondary-transfer first roller 24.

According to the configuration of the present embodiment, the first cam 310, the second cam 311, the cam drive motor 320, and the swing device 350 constitute a distance adjuster that adjusts the distance between the secondary-transfer second roller 16 and the secondary-transfer first roller 24. As described above, the secondary-transfer second roller 16 serving as a rotatable support rotator includes the cylindrical roller portion 16*b* and the shaft 16*a* that penetrates through the center of rotation of the roller portion 16*b* such that the roller portion 16*b* rotates idly on the shaft 16*a*. Rotation of the shaft 16*a* enables the first cam 310 and the second cam 311 fixed to both ends of the shaft 16*a* in the axial direction to rotate together. Thus, with a power transmission device for transmission of power to the shaft 16*a* at only one end of the shaft 16*a* in the axial direction, the cams 310 and 311 at both ends of the shaft 16*a* rotate.

As described above, according to the present embodiment, the secondary transfer bias having the same polarity as the toner is applied to the cored bar 16*c* of the secondary-transfer second roller 16 while the cored bar 24*b* of the secondary-transfer first roller 24 is grounded. With this configuration, the secondary transfer electric field is formed between the secondary-transfer second roller 16 and the secondary-transfer first roller 24 in the secondary transfer nip so that the toner moves electrostatically from the secondary-transfer second roller side (that is, the intermediate transfer belt 10) to the secondary-transfer first roller side (that is, the recording sheet P). The first shaft bearing 308 that rotatably supports the shaft 16*a* made of metal is made of a conductive slide bearing. The secondary transfer bias power source 309 as a high-voltage power source is connected to the conductive first shaft bearing 308 to output the secondary transfer bias. The secondary transfer bias output from the secondary transfer bias power source 309 is transmitted to the secondary-transfer second roller 16 via the first shaft bearing 308. In the secondary-transfer second roller 16, the secondary transfer bias is transmitted through the shaft 16*a*, the ball bearings 16*e*, the metal cored bars 16*c*, and the elastic layers 16*d* in this recited order, accordingly. The shaft 16*a*, the ball bearing 16*e*, and the metal cored bar 16*c* are made of metal, and the elastic layer 16*d* is conductive.

The detection target disk 303 fixed to one end of the shaft 16*a* includes a detection target 303*a*. The detection target 303*a* rises in the axial direction at a predetermined position in the direction of rotation of the shaft 16*a*. An optical detector 304 is fixed to a detector bracket, which is fixed to the first lateral plate 306*b* of the transfer unit 60. While the shaft 16*a* rotates and comes to a predetermined rotation angle range, the detection target 303*a* of the detection target disk 303 enters between a light emitting element and a light receiving element of the optical detector 304, shutting off the optical path between the light emitting element and the light receiving element. The light receiving element of the optical detector 304 sends a light receiving signal to the controller 70 when receiving light from the light emitting element. Based on the time at which the light receiving signal from the light receiving element is cut off and/or based on a drive amount of the cam drive motor 320 from this time, the controller 70 recognizes the rotation angle position of the cam portion 310*a* of the first cam 310 and the cam portion 311*a* of the second cam 311 fixed to the shaft 16*a*.

As described above, the first cam 310 and the second cam 311 on the shaft 16*a* of the secondary-transfer second roller 16 come into contact with the first idler roller 312 and the second idler roller 313 of the secondary-transfer first roller 24 at a predetermined rotation angle. Subsequently, the first cam 310 and the second cam 311 push back the secondary-transfer first roller 24 against the coil spring 351 in a direction away from the secondary-transfer second roller 16. Hereinafter, the action of "push back" is also referred to as "push down". The amount of push back (hereinafter, referred to as the amount of push down) is determined by the rotation angle position of the first cam 310 and the second cam 311. With an increase in the amount of push down of the secondary-transfer first roller 24, the distance between the secondary-transfer second roller 16 and the secondary-transfer first roller 24 increases.

The first idler roller 312 is disposed on the first shaft 24*c* of the secondary-transfer first roller 24 such that the first idler roller 312 rotates idly. The first idler roller 312 is a ball bearing with an outer diameter slightly smaller than the outer diameter of the secondary-transfer first roller 24 and rotates idly on the circumferential surface of the first shaft 24*c*. The second idler roller 313 having the same configuration as the first idler roller 312 is disposed on the second shaft 24*d* of the secondary-transfer first roller 24 such that the second idler roller 313 rotates idly. As described above, the first cam 310 and the second cam 311 fixed onto the shaft 16*a* of the secondary-transfer second roller 16 come into contact with the first idler roller 312 and the second idler roller 313 at a predetermined rotation angle. More specifically, the first cam 310 fixed onto one end of the shaft 16*a* comes into contact with the first idler roller 312. At the same time, the second cam 311 fixed onto the other end of the shaft 16*a* comes into contact with the second idler roller 313.

Rotation of the first idler roller 312 and the second idler roller 313 is stopped when the first idler roller 312 and the second idler roller 313 contact the first cam 310 and the second cam 311 of the secondary-transfer second roller 16. However, rotation of the secondary-transfer first roller 24 is not hampered. Even when rotation of the first idler roller 312 and the second idler roller 313 stops, the first shaft 24*c* and the second shaft 24*d* of the secondary-transfer first roller 24 freely rotates independent of the idler rollers 312 and 313 because the first idler roller 312 and the second idler roller 313 are ball bearings. The rotation of the idler rollers 312 and 313 is stopped by the cams 310 and 311 contacting the idler rollers 312 and 313. This configuration prevents sliding friction of the cams 310 and 311 and the idler rollers 312 and 313, while preventing an increase in the torque of the cam drive motor 320 and the drive motor for the secondary-transfer first roller 24.

Figure 4:
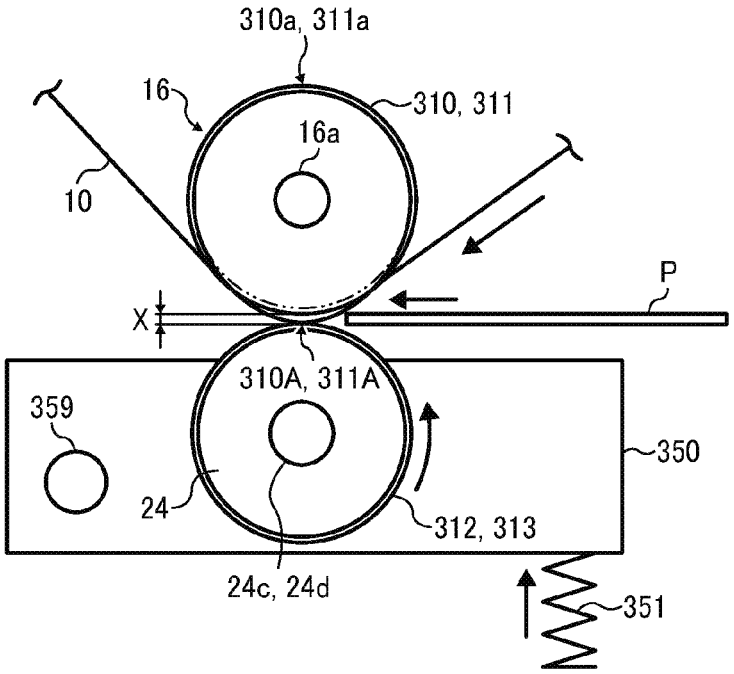
FIG. 4 is a view of a state in which the contact-separation mechanism separates the secondary-transfer first roller from the intermediate transfer belt when a recording sheet enters a secondary transfer nip.
Figure 5:
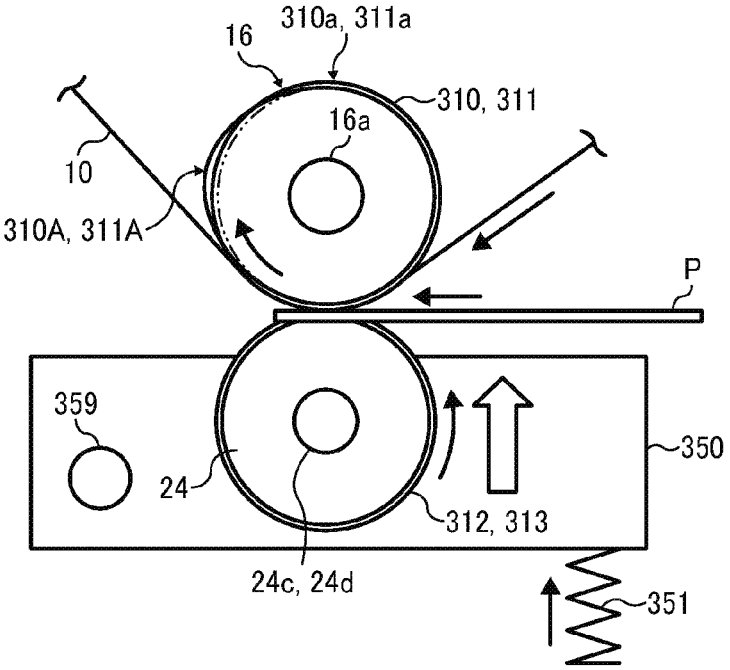
FIG. 5 is a view of a state in which the contact-separation mechanism contacts the secondary-transfer first roller with the intermediate transfer belt, with the recording sheet interposed between the secondary-transfer first roller and the intermediate transfer belt while the recording sheet passes through the secondary transfer nip.

FIG. 4 is a view of a state in which the contact-separation mechanism 130 separates the secondary-transfer first roller 24 from the intermediate transfer belt 10 when the recording sheet P enters the secondary transfer nip. FIG. 5 is a view of a state in which the contact-separation mechanism 130 contacts the secondary-transfer first roller 24 against the intermediate transfer belt 10, with the recording sheet P interposed between the secondary-transfer first roller 24 and the intermediate transfer belt 10 while the recording sheet P passes through the secondary transfer nip. In the image forming apparatus 1 according to the present embodiment, a contact-and-separation operation of the secondary-transfer first roller 24 is carried out by using cams for contact and separation. With such contact-and-separation operation, a shock jitter that occurs when a recording sheet enters and exits the secondary transfer nip is reduced, while preventing contamination of the recording sheet with a test image for adjustment of image density formed between successive recording sheets.

In the image forming apparatus 1 according to the present embodiment, the swing device 350, which swings about a shaft 359 relative to the apparatus body, supports the first shaft 24*c* and the second shaft 24*d* of the secondary-transfer first roller 24 such that the first shaft 24*c* and the second shaft 24*d* rotates. The swing device 350 includes the coil spring 351 at the bottom surface that biases the swing device 350 upward as indicated by arrow in FIG. 4 to push the secondary-transfer first roller 24 toward the secondary-transfer second roller 16. According to the present embodiment, when the recording sheet P enters the secondary nip, as illustrated in FIG. 4, the rotation of the shaft 16*a* of the secondary-transfer second roller 16 is stopped at a position where a convex portion of the cam portion 310*a* of the first cam 310 and another convex portion of the cam portion 311 a of the second cam 311 come into contact with the first idler roller 312 and the second idler roller 313. That is, when the recording sheet P passes the secondary transfer nip, the first cam 310 and the second cam 311 push down the secondary-transfer first roller 24, thereby forming a space X between the secondary-transfer first roller 24 and the intermediate transfer belt 10.

With this configuration in which space X is formed between the secondary-transfer first roller 24 and the intermediate transfer belt 10, even when a recording sheet enters the secondary transfer nip during transfer, a significant load fluctuation does not occur relative to the intermediate transfer belt 10 and the secondary-transfer first roller 24. A desired size of space X between the secondary-transfer first roller 24 and the intermediate transfer belt 10 ranges from approximately 0.1 mm to 2 mm. However, the size of space X is not limited to the above-described numerical values. The size of space X is also referred to as "the amount of separation" of the secondary-transfer first roller 24 from the intermediate transfer belt 10, or just as "the distance" between the secondary-transfer first roller 24 and the intermediate transfer belt 10.

By contrast, when the recording sheet P is fed to the secondary transfer nip with the secondary-transfer first roller 24 pushed down, a transfer pressure is not sufficient to transfer a toner image from the intermediate transfer belt 10 onto the recording sheet P in the secondary transfer nip, resulting in degradation of transferability of the toner image. In particular, the transfer rate drops significantly when the surface of the recording sheet P is not smooth.

According to the present embodiment, immediately after the recording sheet P enters the secondary nip, as illustrated in FIG. 5, the shaft 16*a* of the secondary-transfer second roller 16 rotates to a position where the convex portion of the cam portion 310*a* of the first cam 310 and the convex portion of the cam portion 311 a of the second cam 311 do not contact the first idler roller 312 and the second idler roller 313. That is, the rotation of the cams 310 and 311 in the clockwise direction or in the counterclockwise direction is stopped at a position where the first cam 310 and the second cam 311 do not contact the first idler roller 312 and the second idler roller 313. The cam portions 310*a* and 311*a* have first circumferential portions 310A and 311A, respectively. During the transfer of a toner image from the intermediate transfer belt 10 onto the recording sheet P, the first circumferential portions 310A and 311A are maintained at a position where the first circumferential portions 310A and 311A are not in contact with the idler roller 312 and the second idler roller 313 of the secondary-transfer first roller 24. With this configuration, a reduction in nip pressure at the secondary transfer nip is prevented, preventing a reduction in transferability of a toner image from the intermediate transfer belt 10 onto a thick paper.

Figure 6:
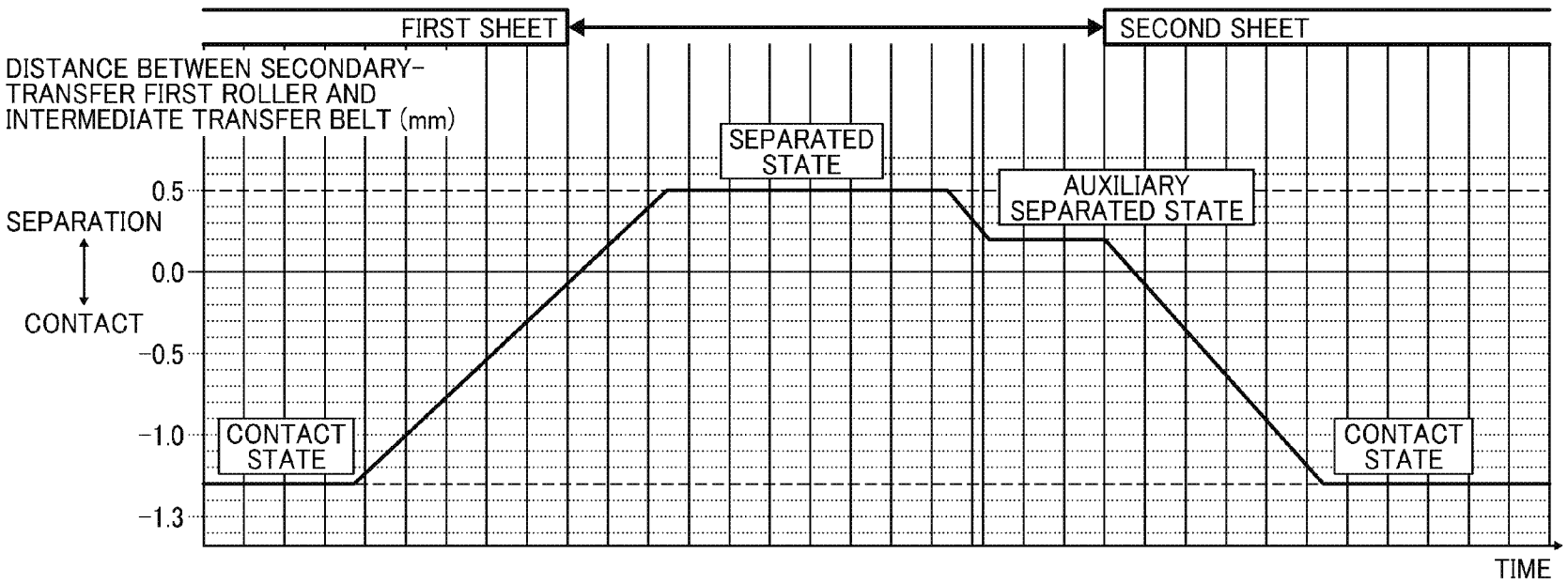
FIG. 6 is a graph of a sequence of a contact-and-separation operation for secondary transfer during a print job.

FIG. 6 is a graph of a sequence of a contact-and-separation operation for secondary transfer during a print job. The horizontal axis represents time, and the vertical axis represents the distance between the secondary-transfer first roller 24 and the intermediate transfer belt 10. One division in the horizontal axis is 10 msec/div. The vertical axis reads positive values while the secondary-transfer first roller 24 is separated from the intermediate transfer belt 10 (which is referred to as a separated state), and reads negative values while the secondary-transfer first roller 24 contacts the intermediate transfer belt 10 (which is referred to as a contact state). After the first recording sheet P exits the secondary transfer nip, a separated state changes to an auxiliary separated state before the second recording sheet P enters the secondary transfer nip. In the separated state, the amount of separation of the secondary-transfer first roller 24 from the intermediate transfer belt 10 is maximum. In the auxiliary separated state, the amount of separation of the secondary-transfer first roller 24 from the intermediate transfer belt 10 is smaller than the amount of separation in the separated state. Then, the auxiliary separated state changes to the contact state when the recording sheet P enters the secondary transfer nip. In the contact state, the secondary-transfer first roller 24 contacts the intermediate transfer belt 10 with the recording sheet P interposed between the secondary-transfer first roller 24 and the intermediate transfer belt 10. In the present embodiment, the rotational position of the cams 310 and 311 in the separated state is designated as a home position of the rotational position of the cams 310 and 311. After the trailing edge of a leading recording sheet P exits the secondary transfer nip, the cams 310 and 311 rotates to a rotational position as the home position and waits at the home position, which means that the cams 310 and 311 wait in the separated state. Before a subsequent recording sheet P enters the secondary transfer nip, the cams 310 and 311 rotates to a rotational position to obtain the amount of separation of the secondary-transfer first roller 24 from the intermediate transfer belt 10 corresponding to the thickness of the subsequent recording sheet P, to achieve the auxiliary separated state.

Figure 7A:
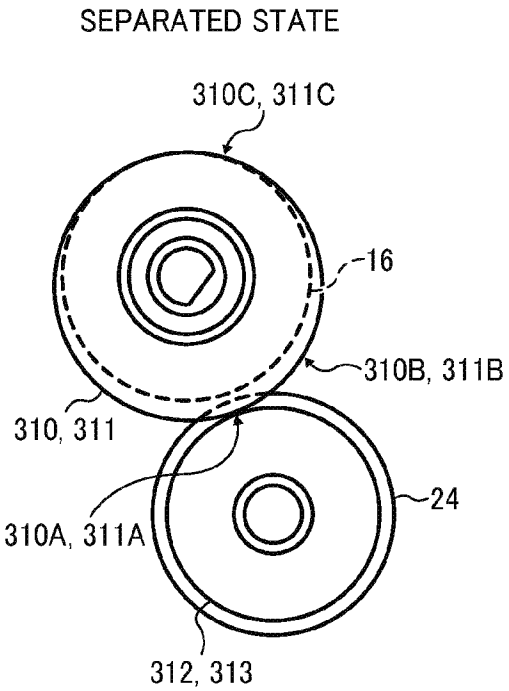
FIG. 7A is a schematic diagram illustrating the relative positions of the secondary-transfer first roller and the secondary-transfer second roller in the separated state.
Figure 7B:
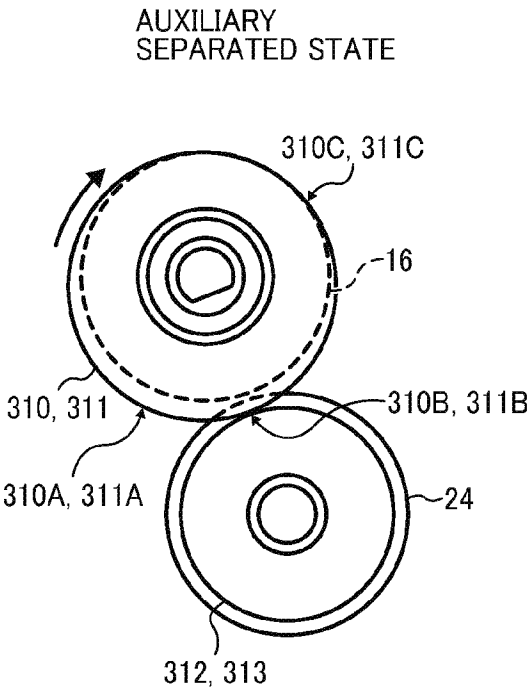
FIG. 7B is a schematic diagram illustrating the relative positions of the secondary-transfer first roller and the secondary-transfer second roller in the auxiliary separated state; and, FIG. 7C is a schematic diagram illustrating the relative positions of the secondary-transfer first roller and the secondary-transfer second roller in the contact state.
Figure 7C:
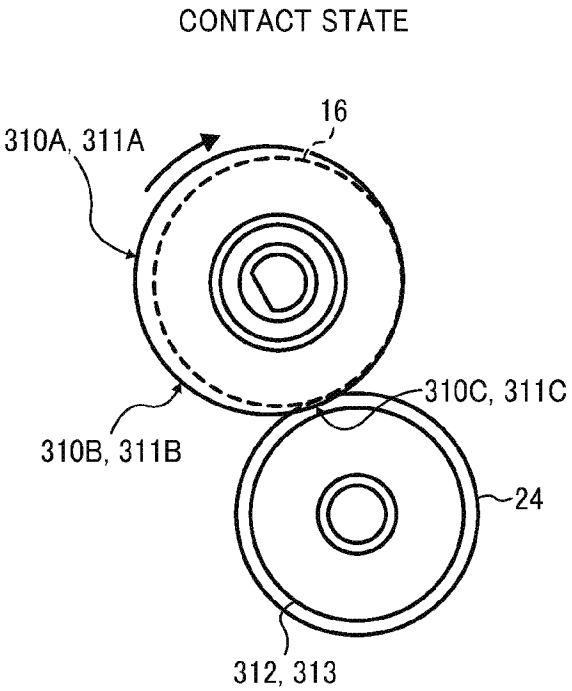

FIG. 7A is a schematic diagram illustrating the relative positions of the secondary-transfer second roller 16 and the secondary-transfer first roller 24 in the separated state. FIG. 7B is a schematic diagram illustrating the relative positions of the secondary-transfer second roller 16 and the secondary-transfer first roller 24 in the auxiliary separated state. FIG. 7C is a schematic diagram illustrating the relative positions of the secondary-transfer second roller 16 and the secondary-transfer first roller 24 in the contact state.

Each of the cams 310 and 311 has a top dead center with a flat surface, to which the distance from the rotational center of each cam 310 (311) is greatest on the circumferential surface of each cam 310 (311). The top dead center is within the range of a central angle of 32° at the rotational axis of each cam 310 (311), on the circumferential surface of each cam 310 (311). In the separated state in which the intermediate transfer belt 10 is not in contact with the secondary-transfer first roller 24 as illustrated in FIG. 7A, the top dead points on the circumferential surfaces of the cams 310 and 311 contact with the circumferential surfaces of the first idler roller 312 and the second idler roller 313, respectively.

At least one position is previously set in a continuous sloped surface 310B (311B), which lies from the top dead center in the circumferential surface of each cam 310 (311) on one side of the direction of rotation of the cam, according to the thickness and/or the type of the recording sheet P. At the previously set position, the circumferential surfaces of the first cam 310 and the second cam 311 contact the first idler roller 312 and the second idler roller 313, respectively. To change the state from the separated state to the auxiliary separated state, the first cam 310 and the second cam 311 rotates from the position illustrated in FIG. 7A toward the clockwise direction indicated by arrow. Then, at the previously set position on the circumferential surface of each cam 310 (311), the circumferential surfaces of the first cam 310 and the second cam 311 contact the first idler roller 312 and the second idler roller 313, respectively. After such contact, the secondary-transfer first roller 24 comes close to the secondary-transfer second roller 16 to achieve a position of the amount of separation smaller than the greatest amount of separation between the secondary-transfer first roller 24 and the intermediate transfer belt 10, thus achieving the auxiliary separated state as illustrated in FIG. 7B. This auxiliary separated state is maintained until the subsequent recording sheet P enters the secondary transfer nip.

To change the state from the auxiliary separated state to the contact state, the first cam 310 and the second cam 311 rotate from the position illustrated in FIG. 7B toward the clockwise direction indicated by arrow after the recording sheet P enters the secondary transfer nip. With the first cam 310 and the second cam 311 not in contact with the first idler roller 312 and the second idler roller 313, the secondary-transfer first roller 24 contacts the secondary-transfer second roller 16 with the intermediate transfer belt 10 and the recording sheet P interposed between the secondary-transfer first roller 24 and the secondary-transfer second roller 16, thus achieving the contact state as illustrated in FIG. 7C. It is to be noted that, with the change from the auxiliary separated state to the contact state to apply a desired level of transfer pressure within the range of 4 mm from the leading edge of the recording sheet P in the direction of conveyance or recording sheet, a visually identified transfer failure is eliminated or reduced.

In the image forming apparatus 1 according to the present embodiment, the amount of separation between the secondary-transfer first roller 24 and the intermediate transfer belt 10 in the auxiliary separated state is variable according to at least the thickness of the recording sheet P. That is, with a plurality of positions set on the continuous sloped surface 310B (311B) of each cam 310 (311) to obtain different amounts of separation, the controller 70 controls the contact-separation mechanism 130 to achieve an appropriate amount of separation according to the thickness of the recording sheet P when the recording sheet P enters the secondary transfer nip. It is to be noted that, the first cam 310 and the second cam 311 includes the first circumferential portions 310A and 311A, respectively to contact the first idler roller 312 and the second idler roller 313, to obtain the greatest amount of separation between the secondary-transfer first roller 24 and the intermediate transfer belt 10. The first cam 310 and the second cam 311 further includes the second circumferential portions 310 C and 311C, respectively that have no contact with the first idler roller 312 and the second idler roller 313, to contact the secondary-transfer first roller 24 with the intermediate transfer belt 10. Each of the sloped surfaces 310B and 311B ranges from the first circumferential portion 310A (311A) to the second circumferential portion 310C (311C) on one side of the direction of rotation of each cam 310 (311). With this configuration, rotating the cams 310 and 311 in one direction switches the state from the separated state to the auxiliary separated state, and further to the contact state in this order.

Figure 1B:
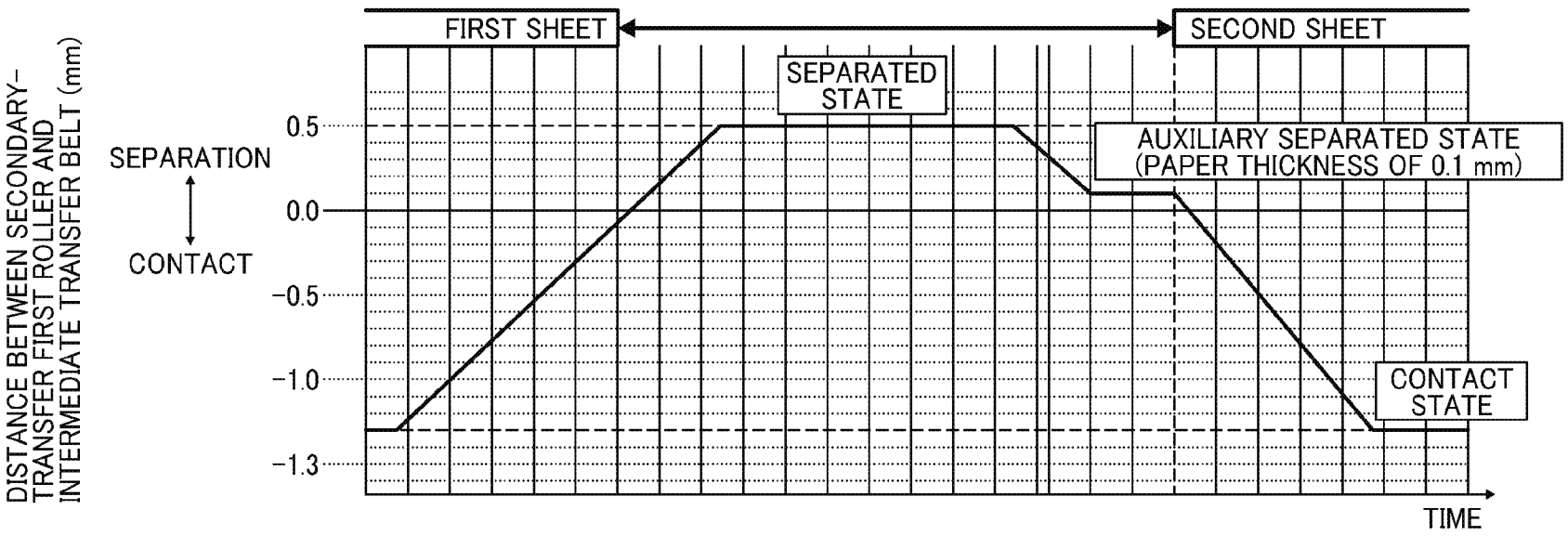
FIG. 1B is a diagram of a sequence of a contact-and-separation operation for secondary transfer during printing on thin paper.

FIG. 1A is a graph of a sequence of a contact-and-separation operation for secondary transfer during printing on thick paper. FIG. 1B is a graph of a sequence of a contact-and-separation operation for secondary transfer during printing on thin paper. In FIG. 1A, thick paper with a thickness of 0.4 mm is printed. During the auxiliary separated state, each cam 310 (311) stops at a rotational position to contact the idler roller 312 (313) at a position on the sloped surface 310B (311B) to obtain an amount of separation (the distance between the secondary-transfer first roller 24 and the intermediate transfer belt 10) of 0.4 mm. The contact-and-separation operation starts to rotate the cams 310 and 311 when the recording sheet P enters the secondary transfer nip. In FIG. 1B, thin paper with a thickness of 0.1 mm is printed. During the auxiliary separated state, each cam 310 (311) stops at a rotational position to contact the idler roller 312 (313) at a position on the sloped surface 310B (311B) to obtain an amount of separation (the distance between the secondary-transfer first roller 24 and the intermediate transfer belt 10) of 0.1 mm. The contact-and-separation operation starts to rotate the cams 310 and 311 when the recording sheet P enters the secondary transfer nip. In the sequence of the contact-and-separation operation for each of thick paper and thin paper, the controller 70 controls the positions of separation and contact and the timing of starting the operation in the same manner, except for differing in amount of separation during the auxiliary separated state.

In the image forming apparatus 1 according to the present embodiment, with positions on each continuous sloped surface 310B (311B) of the cams 310 (311), to contact the idler roller 312 (313), the amount of separation between the secondary-transfer first roller 24 and the intermediate transfer belt 10 varies. In this case, the plurality of positions on the sloped surface 310B (311B) are associated with the amounts of separation corresponding to the thicknesses of a plurality of recording sheets. With this configuration, the controller 70 controls the contact-separation mechanism 130 to adjust the rotational positions of the first cam 310 and the second cam 311, changing the position on each sloped surface 310B (311B) to contact the idler roller 312 (313) according to the thickness of the recording sheet P, thus achieving the amount of separation according to the thickness of the recording sheet P. Therefore, in the present embodiment, setting the amounts of separation corresponding to the thicknesses of a great number of recording sheets P reduces shock jitter caused by the recording sheet P entering the secondary transfer nip irrespective of difference in thickness of the recording sheet P, as compared to the configuration, in which the amount of separation is changed by different heights of two convex portions of a cam.

In the image forming apparatus 1 according to the present embodiment, in addition to thick paper having a thickness of 0.4 mm and thin paper having a thickness of 0.1 mm, when plain paper having a thickness of 0.25 mm is, for example, printed, the amount of separation at the auxiliary separated state is 0.25 mm. That is, with plain paper having a thickness of 0.25 mm printed, each cam 310 (311) stops at a rotational position to contact the idler roller 312 (313) at a position on the sloped surface 310B (311B) to obtain an amount of separation (the distance between the secondary-transfer first roller 24 and the intermediate transfer belt 10) of 0.4 mm during the auxiliary separated state. Then, the contact-separation operation starts when the recording sheet P enters the secondary transfer nip. In the sequence of the contact-and-separation operation for plain paper, the controller 70 controls the positions of separation and contact and the timing of starting the operation in the same manner, except for differing in amount of separation during the auxiliary separated state.

It is to be noted that, with an increase in the number of convex portions in each cam 310 (311) to address a greater number of recording sheets of different thicknesses, the degree of slope in the diagram of cam when the secondary-transfer first roller 24 contacts with and separates from the intermediate transfer belt 10 increases. This may cause the torque to excessively increase when the secondary-transfer first roller 24 separates from the intermediate transfer belt 10, or may lead to an insufficient holding force to hold the contact between the secondary-transfer first roller 24 and the intermediate transfer belt 10, resulting in stepping out of the stepping motor. Thus, it is not desirable to provide a plurality of convex portions in the cams 310 and 311 corresponding to various amounts of separation to address a great number of sheets of paper having different thicknesses. When a plurality of sheets of paper having different thicknesses are printed, the position of separation differs with the thickness of a subsequent sheet, resulting in a complex configuration for control in operation of cam. However, in the image forming apparatus 1 according to the present embodiment, only the parameter of the amount of separation is varied in the contact-separation operation. This is why a simple configuration for control is possible even with a plurality of sheets of paper having different thicknesses printed.

The image forming apparatus 1 according to the present embodiment includes a paper thickness detector as a recording-medium thickness detector to detect the thickness of a recording sheet P in a sheet conveyance path from a sheet feeder 12 to the secondary transfer nip. Based on the detection result of the paper thickness detector, the controller 70 determines the amount of separation between the intermediate transfer belt 10 and the secondary-transfer first roller 24 when the recording sheet P enters the secondary transfer nip, and controls the contact-and-separation mechanism 130. The paper thickness detector may be a transmission optical detector including a light emitting element and a light receiving element opposed to the light emitting element with the sheet conveyance path interposed between the light emitting element and the light receiving element. The light receiving element receives light emitted by the light emitting element and transmitted through the recording sheet P. A signal corresponding to the intensity of the received light is output as data regarding the thickness of the recording sheet P to the controller 70. It is to be noted that the thickness detector is not limited to a transmission optical detector. Any other suitable detector that detects the thickness of the recording sheet P may be used.

The operation panel of the image forming apparatus 1 may function as an input device through which users input data regarding the thickness and type of the recording sheet P. Based on the input data provided by the users using the operation panel, the controller 70 determines the amount of separation (the distance) between the intermediate transfer belt 10 and the secondary-transfer first roller 24 when the recording sheet P enters the secondary transfer nip, and controls the contact-separation mechanism 130.

In a recording sheet P with a high smoothness, such as a coated sheet, a shock jitter that occurs when the recording sheet P enters the secondary transfer nip is effectively reduced with a smaller amount of separation between the intermediate transfer belt 10 and the secondary-transfer first roller 24 than the amount of separation in plain paper with a lower smoothness than the coated sheet. Accordingly, it is desirable to set the amount of separation according to the type of the recording sheet P, such as plain paper or coated sheet. This configuration, even with thick paper used, reduces the impact when the intermediate transfer belt 10 and the secondary-transfer first roller 24 come into contact with each other, thus reducing shock jitter caused by a sudden change in speed of the intermediate transfer belt 10 due to such impact when a coated sheet is used, as compared to when plain paper is used. This is because the amount of separation with the coated sheet used is smaller than the amount of separation with plain paper used. Thus, the recording sheet P enters the secondary transfer nip with an appropriate amount of separation (distance) between the intermediate transfer belt 10 and the secondary-transfer first roller 24 according to the thickness as well as the type of the recording sheet P, thereby reducing any shock jitter irrespective of different types of the recording sheets P.

Figure 2:
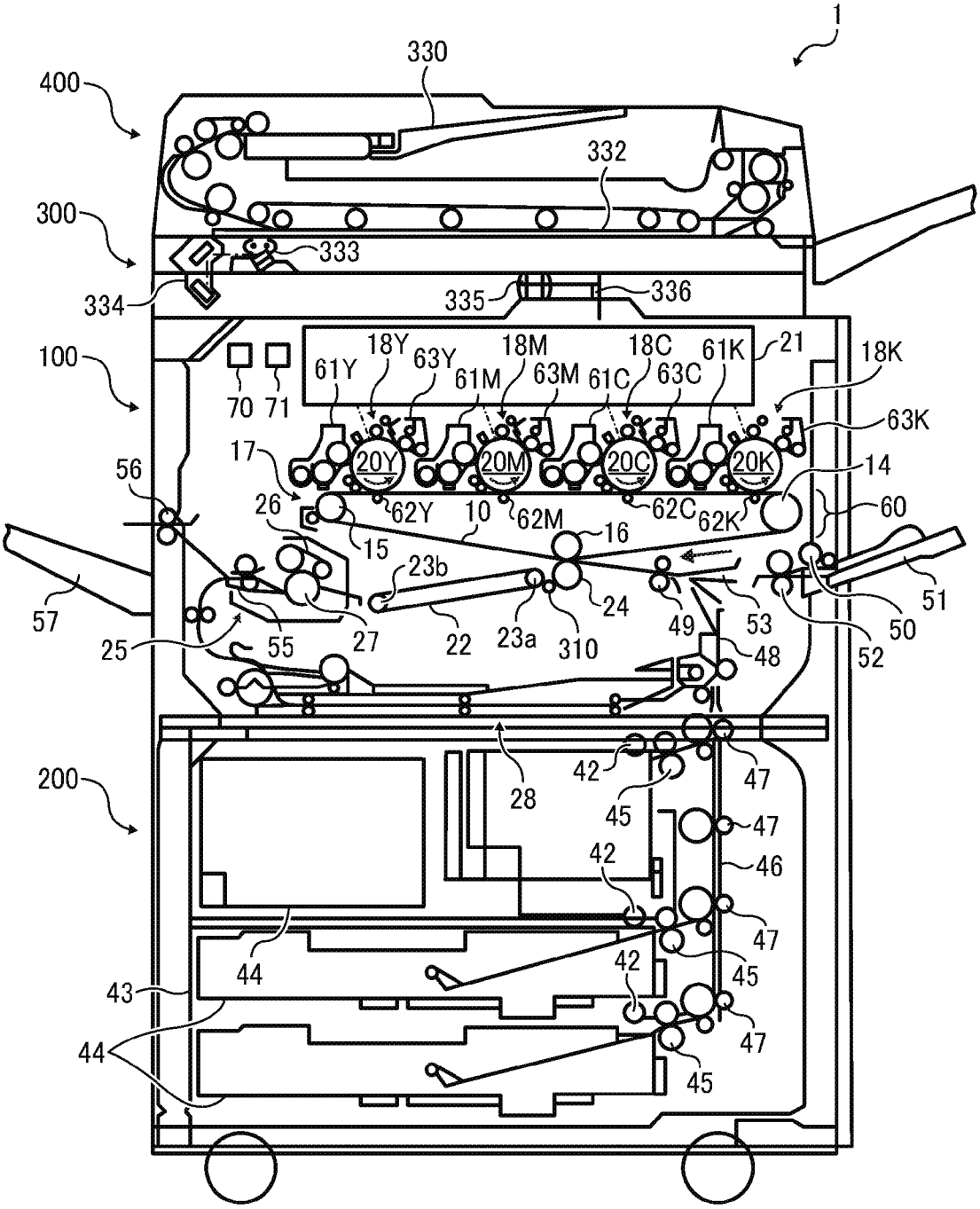
FIG. 2 is a schematic view of an image forming apparatus according to the present embodiment.

In the image forming apparatus 1 according to the present embodiment, the amounts of separation are previously set corresponding to data regarding the recording sheet P, such as brand and thickness. Such corresponding data of the amounts of separation is stored in a storage device 71 of FIG. 2. The controller 70 may obtain the amount of separation corresponding to data regarding the recording sheet P from the storage device 71, and control the contact-separation mechanism 130. With such configuration, the amount of separation of the secondary-transfer first roller 24 from the intermediate transfer belt 10 when the recording sheet P enters the secondary transfer nip is appropriately set according to data regarding the recording sheet P, such as brand with a predetermined thickness and type.

Although an embodiment of the present disclosure has been described above, the present disclosure is not limited thereto and a variety of modifications can naturally be made within the scope of the present disclosure.

In the contact-separation mechanism 130 of the image forming apparatus 1 according to the present embodiment, the first cam 310 and the second cam 311 are disposed on the respective ends of the shaft of the secondary-transfer second roller 16, and the first idler roller 312 and the second idler roller 313 are disposed on the respective ends of the shaft of the secondary-transfer first roller 24. The configuration of the contact-separation mechanism 130 is not limited to such configuration. In some embodiments, the first cam 310 and the second cam 311 may be disposed on the shaft of the secondary-transfer first roller 24, and the first idler roller 312 and the second idler roller 313 may be disposed on the shaft of the secondary-transfer second roller 16. Further, driving the cam drive motor 320 to rotate the shaft of the secondary-transfer first roller 24 may contact and separate the secondary-transfer first roller 24 against and from the intermediate transfer belt 10.

—Aspect A—

A transfer device as a transfer unit 60 includes an image bearer as an intermediate transfer belt 10 to bear a toner image; a transfer rotator as a secondary-transfer first roller 24 to contact the image bearer to form a transfer nip to transfer the toner image from the image bearer onto a recording medium as a recording sheet P interposed between the image bearer and the transfer rotator. The transfer device further includes an adjuster as a contact-separation mechanism 130 including a rotatable cam 310 and 311 and an opposed member as idler rollers 312 and 313. The cam alternately contacts and separates the transfer rotator against and from the image bearer. The cam has a continuous sloped surface 310B and 311B with a plurality of positions, each position to contact the opposed member to obtain a different amount of separation between the image bearer and the transfer rotator. The transfer device further includes a controller 70 to control the adjuster to adjust the amount of separation between the transfer rotator and the image bearer at each of the plurality of positions according to type or thickness of the recording medium when the recording medium starts to enter the transfer nip.

According to Aspect A, with the plurality of positions in the continuous sloped surface of the cam to contact the opposed member, different amounts of separation between the transfer rotator and the image bearer are obtained. In this case, the plurality of positions on the sloped surface are associated with the amounts of separation corresponding to the thicknesses of a plurality of recording sheets. With this configuration, the controller controls the adjuster to adjust the rotational position of the cam, changing the position on the sloped surface to contact the opposed member according to the thickness of the recording medium, thus achieving the amount of separation according to the thickness of the recording medium. Therefore, in the present embodiment, setting the amounts of separation corresponding to the thicknesses of a great number of recording media reduces shock jitter caused by the recording medium entering the secondary transfer nip irrespective of difference in thickness of the recording medium, as compared to the configuration, in which the amount of separation is changed by different heights of two convex portions of a cam.

—Aspect B—

A transfer device includes an image bearer as an intermediate transfer belt 10 to bear a toner image, a transfer rotator as a secondary-transfer first roller 24 to contact a surface of the image bearer to form a transfer nip to transfer the toner image from the image bearer onto a recording medium as a recording sheet P interposed between the image bearer and the transfer rotator. The transfer device further includes an adjuster as a contact-separation mechanism 130 including a rotatable cam as cams 310 and 311 and an opposed member as idler rollers 312 and 313. The cam alternately contacts and separates the transfer rotator against and from the image bearer. The cam has a first circumferential portion 310A and 311A to contact the opposed member to obtain a greatest amount of separation between the image bearer and the transfer rotator and a second circumferential portion 310C and 311C to separate from the opposed member to contact the transfer rotator with the image bearer. The cam has a plurality of positions in a circumferential surface ranging from the first circumferential portion to the second circumferential portion on one side of a direction of rotation of the cam, each position to obtain a different amount of separation between the image bearer and the transfer rotator, smaller than the greatest amount of separation at the first circumferential portion. The transfer device further includes a controller 70 to control the adjuster to adjust the amount of separation between the transfer rotator and the image bearer at each of the plurality of positions according to type or thickness of the recording medium when the recording medium starts to enter the transfer nip.

According to Aspect B, with the plurality of position in the circumferential surface ranging from the first circumferential portion to the second circumferential portion on one side of the direction of rotation of the cam to contact the opposed member, different amounts of separation between the transfer rotator and the image bearer are obtained. In this case, the amounts of separation at the plurality of positions on the circumferential surface are associated with the amounts of separation corresponding to the thicknesses of a plurality of recording media when the recording media enter the transfer nip. With this configuration, the controller controls the adjuster to adjust the rotational position of the cam, changing the position on the circumferential surface to contact the opposed member according to the thickness of the recording medium when the recording medium enters the secondary transfer nip, thus achieving the amount of separation according to the thickness of the recording medium. Therefore, in the present embodiment, setting the amounts of separation corresponding to the thicknesses of a great number of recording media reduces shock jitter caused by the recording medium entering the secondary transfer nip irrespective of difference in thickness of the recording medium, as compared to the configuration, in which the amount of separation is changed by different heights of two convex portions of a cam.

—Aspect C—

According to Aspect A, the cam has a first circumferential portion to contact the opposed member to obtain a greatest amount of separation between the image bearer and the transfer rotator and a second circumferential portion to separate from the opposed member to contact the transfer rotator with the image bearer. The continuous sloped surface ranges from the first circumferential portion to the second circumferential portion on one side of the direction of rotation of the cam.

According to Aspect C, as described in the embodiment, rotating the cams in the same direction changes the amount of separation, which simplifies the control in the transfer device.

—Aspect D—

According to Aspect B or C, a rotational position of the cam to contact the first circumferential portion against the opposed member is a home position.

According to Aspect D, as described in the embodiment, the controller appropriately controls the rotational position of the cams with the first circumferential portion as the reference position to change the amount of separation between the intermediate transfer belt 10 and the secondary-transfer first roller 24.

—Aspect E—

According to Aspect D, the first circumferential portion is planar.

According to Aspect E, as described in the embodiment, the rotational position of the cams is maintained at the separated state with the power off during standby.

—Aspect F—

According to any one of Aspect A through Aspect E, the controller controls the adjuster to adjust the amount of separation at each of the plurality of positions according to the type of recording medium when the recording medium starts to enter the transfer nip.

According to Aspect F, as described in the embodiment, the amount of separation between the intermediate transfer belt 10 and the secondary-transfer first roller 24 when the recording medium starts to enter the transfer nip varies according to the type of the recording medium. Accordingly, any shock jitter caused by the recording medium entering the transfer nip is reduced irrespective of different types of the recording media.

—Aspect G—

According to any one of Aspect A through Aspect F, a separation state to keep the transfer rotator away from the image bearer changes to an auxiliary separation state to obtain an amount of separation smaller than an amount of separation in the separation state before the recording medium starts to enter the transfer nip. The auxiliary separation state changes to a contact state to contact the transfer rotator with the image bearer when the recording medium starts to enter the transfer nip.

According to Aspect G, as described in the embodiment, a shock jitter caused by the recording medium entering the transfer nip is reduced.

—Aspect H—

According to any one of Aspect A through Aspect G, the transfer device further includes a recording-medium thickness detector to obtain data regarding the thickness of the recording medium. The controller controls the adjuster to operate in response to the data obtained by the recording-medium thickness detector.

According to Aspect H, as described in the embodiment, the amount of separation between the intermediate transfer belt 10 and the secondary-transfer first roller 24 varies according to the thickness of the recording medium.

—Aspect I—

According to any one of Aspect A through Aspect H, the transfer device further includes a recording-medium type detector to obtain data regarding the type of the recording medium. The controller controls the adjuster to operate in response to the data obtained by the recording-medium type detector.

According to Aspect I, as described in the embodiment, the amount of separation between the intermediate transfer belt 10 and the secondary-transfer first roller 24 when the recording medium starts to enter the transfer nip more reliably varies according to the type of the recording medium.

—Aspect J—

According to any one of Aspect A through Aspect G, the transfer device further includes a storage device to store the amount of separation previously set according to data regarding the recording medium. The controller obtains the amount of separation according to the data regarding the recording medium from the storage device, to controls the adjuster to operate.

According to Aspect J, as described in the embodiment, the amount of separation between the intermediate transfer belt 10 and the secondary-transfer first roller 24 when the recording medium starts to enter the transfer nip varies according to data regarding the recording medium, such as a brand of the recording medium with a predetermined thickness and type.

—Aspect K—

An image forming apparatus 60 includes the transfer device according to any one of Aspect A through Aspect J.

According to Aspect K, as described in the embodiment, shock jitter caused by the recording medium entering the transfer nip is reduced irrespective of different thicknesses of the recording media, thus forming a favorable image.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A transfer device comprising:

an image bearer to bear a toner image;

a transfer rotator to contact the image bearer to form a transfer nip to transfer the toner image from the image bearer onto a recording medium interposed between the image bearer and the transfer rotator;

an adjuster including a rotatable cam and an opposed member opposed to the cam, the cam to alternately contact and separate the transfer rotator against and from the image bearer, the cam having a continuous sloped surface with a plurality of positions, each position to contact the opposed member to obtain a different amount of separation between the image bearer and the transfer rotator; and a controller operatively connected to the adjuster to control the adjuster to adjust the amount of separation between the transfer rotator and the image bearer according to type or thickness of the recording medium when the recording medium starts to enter the transfer nip, wherein the controller controls the adjuster to change a separation state to keep the transfer rotator away from the image bearer to an auxiliary separation state to obtain an amount of separation smaller than an amount of separation in the separation state before the recording medium starts to enter the transfer nip, and wherein the controller controls the adjuster to change the auxiliary separation state to a contact state to contact the transfer rotator against the image bearer when the recording medium starts to enter the transfer nip.

2. The transfer device according to claim 1, wherein the cam has a first circumferential portion to contact the opposed member to obtain a greatest amount of separation between the image bearer and the transfer rotator and a second circumferential portion to separate from the opposed member to contact the transfer rotator against the image bearer, and wherein the continuous sloped surface ranges from the first circumferential portion to the second circumferential portion on one side of the direction of rotation of the cam.

3. The transfer device according to claim 2, wherein a rotational position of the cam to contact the first circumferential portion against the opposed member is a home position.

4. The transfer device according to claim 3, wherein the first circumferential portion is planar.

5. The transfer device according to claim 1, wherein with the plurality of positions, the controller controls the adjuster to adjust the amount of separation according to the type of recording medium when the recording medium starts to enter the transfer nip.

6. The transfer device according to claim 1, further comprising a recording-medium thickness detector to obtain data regarding the thickness of the recording medium, wherein the controller controls the adjuster to operate in response to the data obtained by the recording-medium thickness detector.

7. The transfer device according to claim 1, further comprising a recording-medium type detector to obtain data regarding the type of the recording medium, wherein the controller controls the adjuster to operate in response to the data obtained by the recording-medium type detector.

8. The transfer device according to claim 1, further comprising a storage device to store the amount of separation previously set according to data regarding the recording medium, wherein the controller obtains the amount of separation according to the data regarding the recording medium from the storage device, to control the adjuster to operate.

9. An image forming apparatus comprising the transfer device according to claim 1.

10. A transfer device comprising:

an image bearer to bear a toner image;

a transfer rotator to contact a surface of the image bearer to form a transfer nip to transfer the toner image from the image bearer onto a recording medium interposed between the image bearer and the transfer rotator;

an adjuster including a rotatable cam and an opposed member opposed to the cam, the cam to alternately contact and separate the transfer rotator against and from the image bearer;

the cam having a first circumferential portion to contact the opposed member to obtain a greatest amount of separation between the image bearer and the transfer rotator and a second circumferential portion to separate from the opposed member to contact the transfer rotator against the image bearer, the cam having a plurality of positions in a circumferential surface ranging from the first circumferential portion to the second circumferential portion on one side of a direction of rotation of the cam, each position to obtain a different amount of separation between the image bearer and the transfer rotator, smaller than the greatest amount of separation at the first circumferential portion; and a controller to control the adjuster to adjust the amount of separation between the transfer rotator and the image bearer at each of the plurality of positions according to type or thickness of the recording medium when the recording medium starts to enter the transfer nip.

11. The transfer device according to claim 10, wherein a rotational position of the cam to contact the first circumferential portion against the opposed member is a home position.

12. The transfer device according to claim 11, wherein the first circumferential portion is planar.

13. The transfer device according to claim 10, wherein with the plurality of positions, the controller controls the adjuster to adjust the amount of separation according to the type of the recording medium when the recording medium starts to enter the transfer nip.

14. The transfer device according to claim 10, wherein the controller controls the adjustor to change a separation state to keep the transfer rotator away from the image bearer to an auxiliary separation state to obtain an amount of separation smaller than an amount of separation in the separation state before the recording medium starts to enter the transfer nip, and wherein the controller controls the adjustor to change the auxiliary separation state to a contact state to contact the transfer rotator with the image bearer when the recording medium starts to enter the transfer nip.

15. The transfer device according to claim 10, further comprising a recording-medium thickness detector to obtain data regarding the thickness of the recording medium, wherein the controller controls the adjuster to operate in response to the data obtained by the recording-medium thickness detector.

16. The transfer device according to claim 10, further comprising a recording-medium type detector to obtain data regarding the type of the recording medium, wherein the controller controls the adjuster to operate in response to the data obtained by the recording-medium type detector.

17. The transfer device according to claim 10, further comprising a storage device to store the amount of separation previously set according to data regarding the recording medium, wherein the controller obtains the amount of separation according to the data regarding the recording medium from the storage device, to control the adjuster to operate.

18. An image forming apparatus comprising the transfer device according to claim 10.

19. A transfer device comprising:

an image bearer to bear a toner image;

a transfer rotator to contact the image bearer to form a transfer nip to transfer the toner image from the image bearer onto a recording medium interposed between the image bearer and the transfer rotator;

an adjuster including a rotatable cam and an opposed member opposed to the cam, the cam to alternately contact and separate the transfer rotator against and from the image bearer, the cam having a continuous sloped surface with a plurality of positions, each position to contact the opposed member to obtain a different amount of separation between the image bearer and the transfer rotator; and a controller operatively connected to the adjuster to control the adjuster to change a separation state to keep the transfer rotator away from the image bearer to an auxiliary separation state to obtain an amount of separation smaller than an amount of separation in the separation state before the recording medium starts to enter the transfer nip, wherein the amount of separation in the auxiliary separation state is a first amount when a thickness of the recording medium is a first thickness, and wherein the amount of separation in the auxiliary separation state is a second amount smaller than the first amount when the thickness of the recording medium is a second thickness smaller than the first thickness.

* * * * *